US006840025B1

(12) United States Patent
Chapman

(10) Patent No.: US 6,840,025 B1
(45) Date of Patent: Jan. 11, 2005

(54) DEPOSITING A STACK OF FLEXIBLE ARTICLES

(75) Inventor: Peter Miles Chapman, Warneet (AU)

(73) Assignee: Ansell Services, Inc., Red Bank, NJ (US)

( * ) Notice: Subject to any disclaimer, the term of this patent is extended or adjusted under 35 U.S.C. 154(b) by 9 days.

(21) Appl. No.: 10/111,176

(22) PCT Filed: Oct. 20, 2000

(86) PCT No.: PCT/AU00/01293

§ 371 (c)(1),
(2), (4) Date: Jul. 17, 2002

(87) PCT Pub. No.: WO01/28855

PCT Pub. Date: Apr. 26, 2001

(30) Foreign Application Priority Data

Oct. 20, 1999 (MY) ..... PI 990 4534

(51) Int. Cl.[7] ..... B65B 5/10
(52) U.S. Cl. ..... 53/475; 53/241
(58) Field of Search ..... 53/241, 258, 259, 53/436, 438, 439, 458, 475, 524, 527, 529, 530

(56) References Cited

U.S. PATENT DOCUMENTS 3,327,449 A * 6/1967 Bullhorst et al. ..... 53/438
4,660,352 A * 4/1987 Deines et al. ..... 53/438
5,022,216 A 6/1991 Muckenfuhs et al.
5,375,967 A 12/1994 Rathert
5,459,979 A 10/1995 Tommasi

FOREIGN PATENT DOCUMENTS

EP 400 598 12/1990
SE 82049206 2/1984

* cited by examiner

*Primary Examiner*—Rinaldi I. Rada
*Assistant Examiner*—John Paradiso
(74) *Attorney, Agent, or Firm*—Gardner Carton & Douglas LLP

(57) ABSTRACT

Apparatus for depositing a stack of flexible articles, includes stack deposit means (12) for contacting the stack and placing it with respect to a reference point. The stack deposit means has at least one surface means (30) for contacting the top or bottom of the stack. Means (15) is provided to withdraw the at least one surface means in a direction substantially parallel to the top or bottom of the stack, respectively. The at least one surface means is arranged so that any surface (31) thereof in contact with the top or bottom of the stack, respectively, moves at a relative speed along the top or bottom of the stack sufficiently less than the speed of withdrawal of the surface means to substantially prevent rolling of the articles of the stack during withdrawal.

25 Claims, 3 Drawing Sheets

FIGURE 3
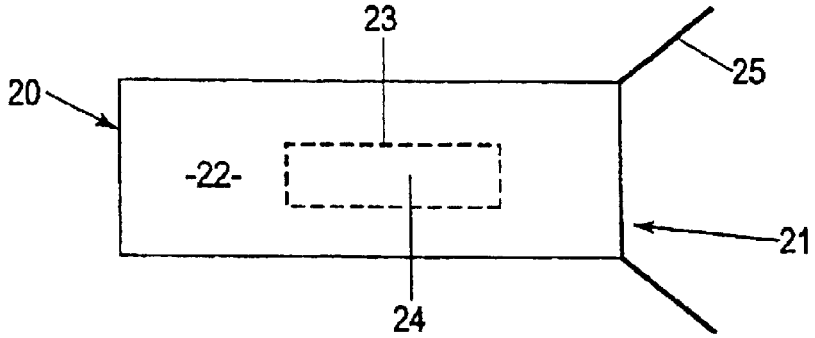
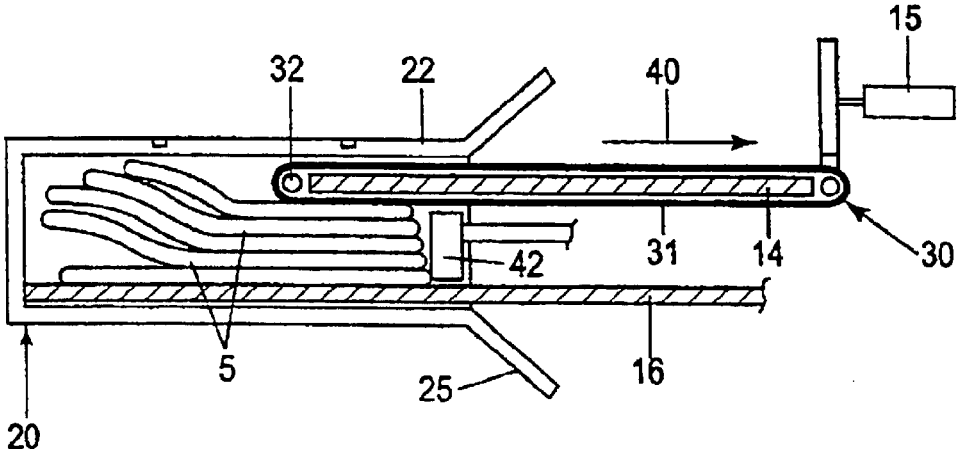
FIGURE 4

DEPOSITING A STACK OF FLEXIBLE ARTICLES

FIELD OF THE INVENTION

This invention relates generally to the handling of flexible articles in stacks, and is of particular utility in the packaging of flexible articles for subsequent individual withdrawal. Such articles include, for example, elastomeric gloves.

BACKGROUND ART

A known arrangement for packaging stacks of elastomeric gloves is to place the stack within a box, through a temporarily open end of the box, between a pair of vertically spaced plates that grip the stack between them. One plate may be a U-shaped tray. The plates compress the stack between them, and the stack may be inserted in the open box, or vice versa.

Once insertion is completed, the top and bottom plates are withdrawn in turn, parallel to the top or bottom of the stack respectively, while a lateral stationary plate acts as a stop to maintain the stack in the box. The top and bottom plates may be separated slightly vertically before withdrawal.

For gloves made in high friction materials, which offer user benefits, this approach can lead to rolling of the surfaces exposed to the plates or trays. This results in an unsightly appearance when the pack is opened, typically by tearing away of a finger exaction window, and also makes removal of a single glove difficult.

FIG. 1 schematically illustrates an example of conventional glove packaging apparatus, depicting the effect on the top gloves 5*a* of the stack 6' of withdrawal of the top plate 14'. The bottom plate is indicated at 16'. The top gloves, restrained by side plate 42', are partially rolled back on themselves by plate 14'. The result, on opening the box 20' for use by pressing out tab 24' with score lines 23', is an unsightly appearance and difficulty in removing the top few gloves through the opening left by tab 24'.

It is an object of the invention to at least in part alleviate this problem.

SUMMARY OF THE INVENTION

The invention provides an apparatus for depositing a stack of flexible articles, which includes stack deposit means for contacting the stack and placing it with respect to a reference point, which means includes at least one surface means for contacting the top or bottom of the stack, and means to withdraw the at least one surface means in a direction substantially parallel to the top or bottom of the stack, respectively. The at least one surface means is arranged so that any surface thereof in contact with the top or bottom of the stack, respectively, is driven by frictional contact with the stack so that said surface moves oppositely to said direction of withdrawal of the surface means at a relative speed along the top or bottom of the stack sufficiently less than the speed of withdrawal of the surface means to substantially prevent rolling of the articles of the stack during withdrawal. The apparatus further has lateral stop means for restraining said stack during said withdrawal of the surface means.

The aforementioned relative speed along the top or bottom of the stack is preferably zero.

The at least one surface means may include belt means defining the surface in contact with the top or bottom of the stack. In one embodiment, the belt means is a continuous belt.

In another embodiment, the belt means is a belt extending between two mounting positions, arranged to roll away from the top or bottom of the stack as the at least one surface means is withdrawn. Roller means may be included to facilitate the rolling away of the belt.

Advantageously, the arrangement is such that, during operation, there is no slip between the stack and the belt, whereby said relative speed along the top or bottom of the stack is substantially zero.

Typically, the stack deposit means includes further surface means for contacting the bottom or top of the stack, respectively. The characterising features of the invention may alternatively or additionally be incorporated in this further surface means.

Preferably, the stack deposit means is arranged for placing the stack into a box from which the articles of the stack may be withdrawn individually by subsequent users.

The lateral stop means can also be used to reposition the stack between the surfaces.

The invention further provides a method for depositing a stack of flexible articles, including contacting said stack within at least one surface means; withdrawing said at least one surface means in a direction substantially parallel to the top or bottom of the stack, respectively, said at least one surface means being arranged so that any surface thereof in contact with the top or bottom of the stack, respectively, is driven by frictional contact with the stack so that said surface moves oppositely to said direction of withdrawal of the surface means at a relative speed along the top or bottom of the stack sufficiently less than the speed of said withdrawal of the surface means to substantially prevent rolling of the articles of said stack during said withdrawal; and restraining said stack during said withdrawal of the surface means.

In an advantageous application of the invention, the flexible articles are highly flexible thin articles such as gloves, especially elastomeric gloves.

BRIEF DESCRIPTION OF THE DRAWINGS

The invention will now be described, by way of example, with reference to the accompanying drawings, in which:

FIG. 3 is a top plan view of the box;

FIG. 4 is a view similar to FIG. 1 showing the apparatus during withdrawal of the top plate.

PREFERRED EMBODIMENTS

Figure 1:
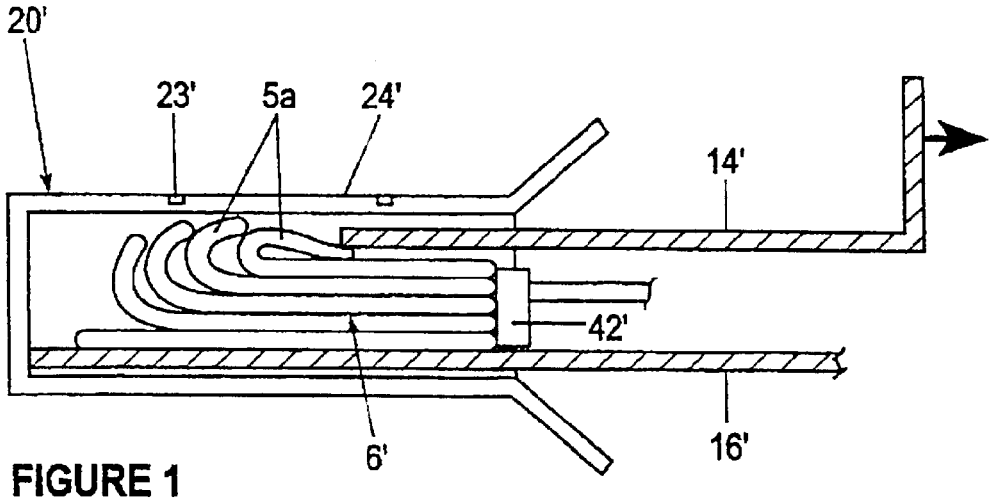
FIG. 1 is a cross-sectional schematic view of conventional glove packaging apparatus, depicting withdrawal of the top plate through an open end of a box in which the glove stack has been earlier placed.
Figure 2:
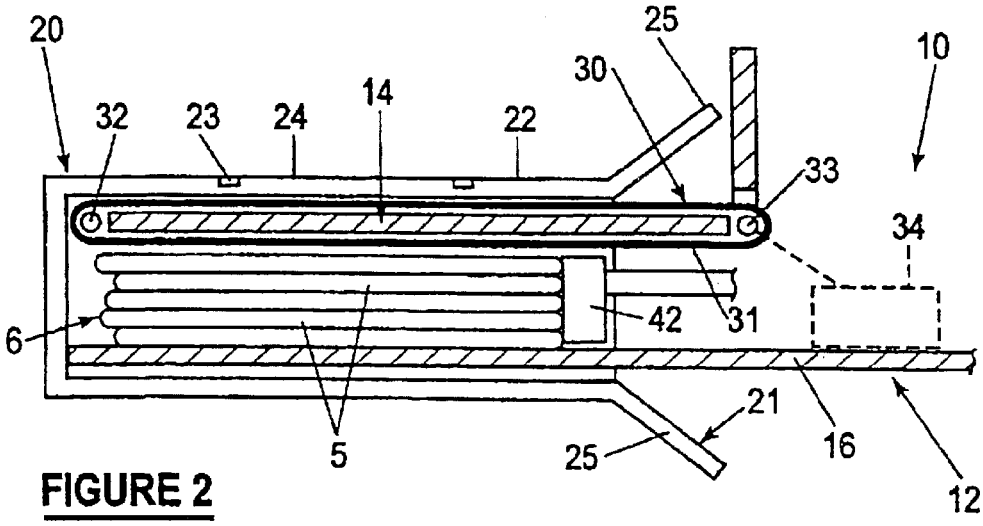
FIG. 2 is a cross-sectional schematic view of glove packaging apparatus according to an embodiment of the invention, shown immediately after insertion of a stack of elastomeric gloves through an open end of a box.

The glove packaging apparatus 10 illustrated in FIGS. 2 to 4 is conventional to the extent that it includes stack deposit means 12 in the form of a pair of top and bottom plates 14, 16 adapted to squeeze a stack 6 of thin elastomeric gloves 5 between them. The plates 14, 16 are driven forwardly in synchronism by suitable fluid powered actuators or linear motors (eg. 15 in FIG. 4), to insert the stack through the open end 21 of a pre-positioned box 20 and thereby place the stack in the box. The box is of a type having, in its top panel 22, a central tab 24 defined by score lines 23 (FIG. 3). This tab is able to be readily pressed out by a subsequent user to provide an opening through which gloves may be individually extracted with the fingers.

In the drawings, the thickness of the gloves 5 is exaggerated for purposes of illustration. The stack may typically contain 100 or so gloves of 0.15 mm thick material In a stack of total depth 75 mm.

To substantially prevent rolling of the top few gloves in the stack during withdrawal of top plate 14, the glove contact surface of plate 14 is not the plate itself but the lower run 31 of a continuous belt 30 mounted about rollers 32, 33 at the front and rear of plate 14 so that the belt 30 extends about and embraces the plate. Rollers 32, 33 are idlers and the belt 30 is driven, on withdrawal of plate 14, by frictional contact with the top glove of the stack. A suitable material for belt 30 is a flexible synthetic conveyor belting.

Once insertion of a stack is completed, an automatic control sequence program in a controller (not shown) reverses the actuator 15 for top plate 14 into withdrawal mode. The plate 14 is now withdrawn through box opening 21, in a direction (FIG. 4, arrow 40) parallel to the top of stack 6. A stationary side plate 42 acts as a stop to restrain the stack 6 during withdrawal of plate 14, and to thereby maintain the stack in position in box 20. This lateral stop can also be used to reposition the stack between the surfaces. The frictional contact between drive belt run 31 and the top glove of the stack is effective to drive belt 30, ie glove contact surface 31, to move in the direction opposite to direction 40. in this way, surface 31 moves at a speed, relative to the stack, along the top of the stack, sufficiently less than the speed of withdrawal of plate 14 and belt 30 to substantially prevent rolling of the top gloves of the stack. Ideally, this relative speed is zero, ie there is no slip between the top glove and the belt surface, but an exact such counterbalance of the retraction of top plate 14 may not strictly be necessary to substantially prevent glove rolling.

Optionally, prior to withdrawal of plate 14, it may be lifted slightly away from plate 16, but to an extent severely constricted by the presence of the box. In another alternative, a motor 34 may be provided to positively drive belt 30. The packaging process is completed by driven withdrawal of bottom plate 16, and then by folding over box flaps 25 to close the end of the box. Since some rolling of the bottom gloves is not as great a problem as rolling of the top gloves, bottom plate 16 does not have a driveable contact belt, but it is of course an option to include a belt similar to belt 30.

In a further possible variation, plates 14, 16 may be withdrawn simultaneously.

Figure 5:
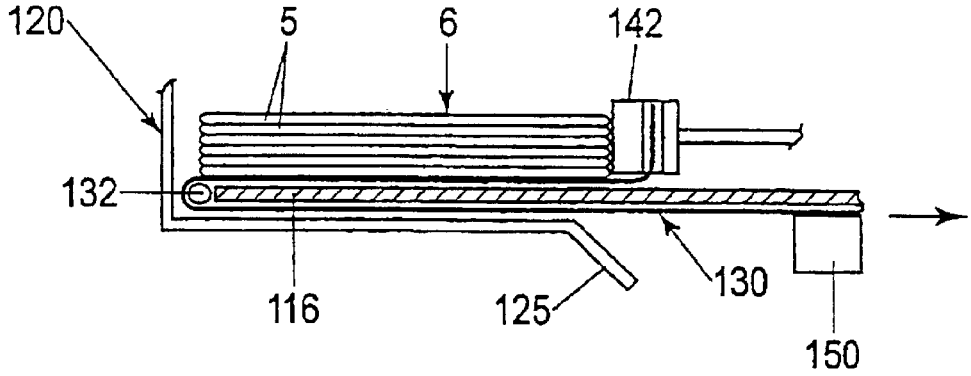
FIGS. 5 and 6 are partial views similar to FIGS. 2 and 4 of glove packaging apparatus according to an alternative embodiment of the invention.
Figure 6:
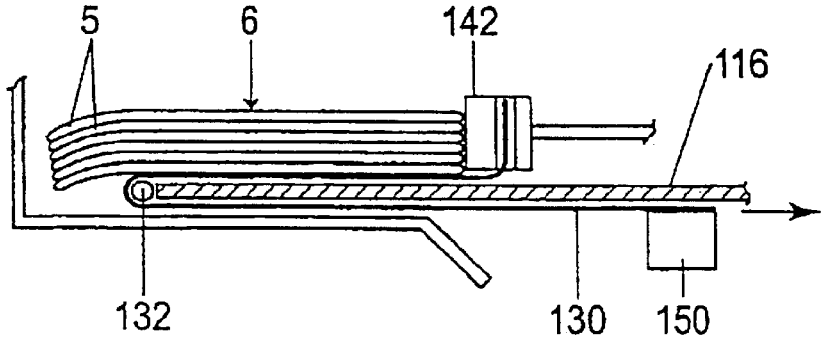

FIGS. 5 and 6 depict an alternative embodiment in which like parts are indicated by like reference numerals preceded by a 1. Here, the bottom plate 116 is the actively withdrawn plate, and there is provided a belt 130 which extends about and embraces plate 116. However, in this case, belt 130 is not continuous but is fixed at one end to side plate 142 and at the other to remote tensioning means 150 below and fixed to the plate or to a stationary part of the machine. An idler roller 132 (or other guide element) guides the belt at the inner edge of plate 116. As plate 116 is withdrawn (FIG. 6), belt 130 remains relatively stationary in a direction along the bottom of the glove stack 6 but rolls away from the stack bottom about roller 132 as the remote end of the belt travels with the plate.

What is claimed is:

1. Apparatus for depositing a stack of flexible articles, including:

stack deposit means for contacting said stack and placing it with respect to a reference point, said stack deposit means arranged for placing said stack into a box, the box having an open end, which means includes at least one surface means for contacting the top or bottom of the stack; and means to withdraw said at least one surface means in a direction substantially parallel to the top or bottom of the stack, respectively, said at least one surface means being arranged so that any surface thereof in contact with the top or bottom of the stack, respectively, is driven by frictional contact with the stack so that said surface moves oppositely to said direction of withdrawal of the surface means at a relative speed along the top or bottom of the stack sufficiently less than the speed of said withdrawal of the surface means to substantially prevent rolling of the articles of said stack during said withdrawal; and lateral stop means positioned to at least partially block the oven end of the box for restraining said stack during said withdrawal of the surface means.

2. Apparatus according to claim 1, wherein said relative speed along the top or bottom of the stack is substantially zero.

3. Apparatus according to claim 2, wherein said at least one surface means includes belt means defining said surface in contact with the top or bottom of the stack.

4. Apparatus according to claim 3 wherein said belt means is a continuous belt.

5. Apparatus according to claim 1, wherein said at least one surface means includes belt means defining said surface in contact with the top or bottom of the stack.

6. Apparatus according to claim 5, wherein said belt means is a belt extending between two mounting positions, arranged to roll away from said top or bottom of the stack as the at least one surface means is withdrawn.

7. Apparatus according to claim 6, further including roller means to facilitate said rolling away of the belt.

8. Apparatus according to claim 6, wherein said at least one surface means further includes plate or frame structure means, about which said belt extends.

9. Apparatus according to claim 5 wherein said belt means is a continuous belt.

10. Apparatus according to claim 5, wherein said at least one surface means further includes plate or frame structure means, about which said belt extends.

11. Apparatus according to claim 5, wherein said flexible articles comprise gloves.

12. Apparatus according to claim 1, wherein the arrangement is such that, during operation, there is no slip between the stack and said surface, whereby said relative speed along the top or bottom of the stack is substantially zero.

13. Apparatus according to claim 1, wherein said stack deposit means includes further surface means for contacting the bottom or top of the stack, respectively.

14. Apparatus according to claim 1, wherein the articles of the stack may be withdrawn individually by subsequent users from the box.

15. Apparatus according to claim 14, wherein said flexible articles comprise gloves.

16. Apparatus according to claim 1, wherein said lateral stop means is adapted to reposition the stack relative to the surface means.

17. Apparatus according to claim 1, wherein said flexible articles comprise gloves.

18. A method for depositing a stack of flexible articles, including:

placing said stack into a box, the box having an open end;

contacting said stack within at least one surface means;

withdrawing said at least one surface means in a direction substantially parallel to the top or bottom of the stack, respectively, said at least one surface means being arranged so that any surface thereof in contact with the top or bottom of the stack, respectively, is driven by frictional contact with the stack so that said surface moves oppositely to said direction of withdrawal of the surface means at a relative speed along the top or bottom of the stack sufficiently less than the speed of said withdrawal of the surface means to substantially prevent rolling of the articles of said stack during said withdrawal; and restraining said stack with lateral stop means positioned to at least partially block the open end of the box during said withdrawal of the surface means.

19. A method according to claim 18, wherein said relative speed along the top or bottom of the stack is substantially zero.

20. A method according to claim 18, wherein there is no slip between the stack and said surface, whereby said relative speed along the top or bottom of the stack is substantially zero.

21. A method according to claim 20, wherein the articles of the stack may be withdrawn individually by subsequent users from the box.

22. A method according to claim 21, wherein said flexible articles comprise gloves.

23. A method according to claim 18, wherein the articles of the stack may be withdrawn individually by subsequent users from the box.

24. A method according to claim 23, wherein said flexible articles comprise gloves.

25. A method according to claim 18, wherein said flexible articles comprise gloves.

* * * * *

UNITED STATES PATENT AND TRADEMARK OFFICE

CERTIFICATE OF CORRECTION

PATENT NO. : 6,840,025 B1
DATED : January 11, 2005
INVENTOR(S) : Chapman

It is certified that error appears in the above-identified patent and that said Letters Patent is hereby corrected as shown below:

Column 4,
Line 22, delete “oven” and insert -- open --.

Signed and Sealed this

Tenth Day of May, 2005

JON W. DUDAS
*Director of the United States Patent and Trademark Office*